United States Patent [19]

McCrudden et al.

[11] 4,412,599

[45] Nov. 1, 1983

[54] LADDER ATTACHMENT

[75] Inventors: Edward McCrudden, 311 Stonechurch Rd., E., Hamilton, Ontario, Canada, L9B 1B1; Frank Shandala, Hamilton, Canada

[73] Assignee: Edward McCrudden, Hamilton, Canada

[21] Appl. No.: 360,155

[22] Filed: Mar. 22, 1982

[30] Foreign Application Priority Data

Feb. 12, 1982 [CA] Canada ..... 396148

[51] Int. Cl.[3] ..... E06C 7/44; E06C 7/48

[52] U.S. Cl. ..... 182/201; 182/27; 182/214; 182/206

[58] Field of Search ..... 182/214, 201–205, 182/120, 107, 206, 27; 248/210, 211, 238, 226.1, 226.3, 228

[56] References Cited

U.S. PATENT DOCUMENTS

| | | | |
|---|---|---|---|
| 1,980,854 | 11/1934 | Eberle | 182/214 |
| 2,360,640 | 10/1944 | Bengert | 182/204 |
| 2,481,581 | 9/1949 | Ehnhuus | 182/201 |
| 3,027,968 | 4/1962 | Ouellette | 182/214 |
| 3,467,418 | 9/1969 | Redditt | 248/228 |
| 3,937,298 | 2/1976 | Hurwitz | 182/204 |
| 4,159,045 | 6/1979 | Brooks | 182/116 |
| 4,184,569 | 1/1980 | Grenier | 182/214 |
| 4,249,638 | 2/1981 | Fernandez | 182/204 |

*Primary Examiner*—Reinaldo P. Machado

*Attorney, Agent, or Firm*—Arne I. Fors; Robert F. Delbridge

[57] ABSTRACT

A ladder attachment for securement to a ladder leg which can function as a ladder standoff, ladder leg extension or roof ridge hook. The ladder standoff arrangement permits the ladder to be supported a predetermined distance from a wall, enables the ladder to be used as a scaffold, or provides a support for a work table or sawhorse.

The attachment comprises a channel having an adjustable web and sidewalls with a reversible angle secured to one sidewall which cooperates with biasing means passing through the channel web and a ladder stile to frictionally lock an elongated member passing through holes formed in the sidewalls as a standoff or roof ridge hook or to frictionally lock an elongated member adjacent a ladder leg as an extension thereof.

10 Claims, 9 Drawing Figures

FIG. 5.
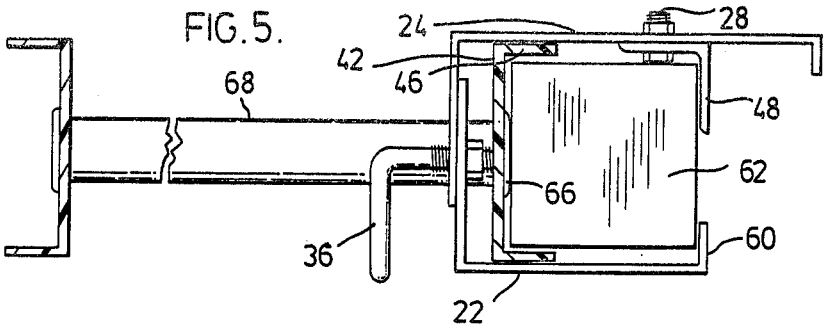
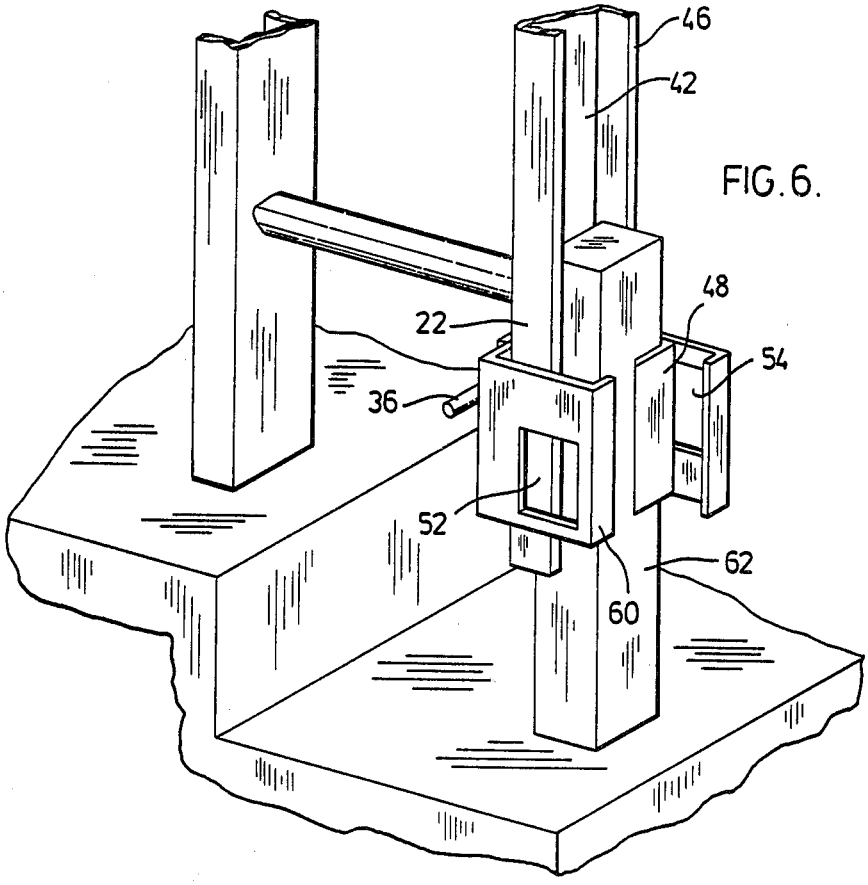
FIG. 6.
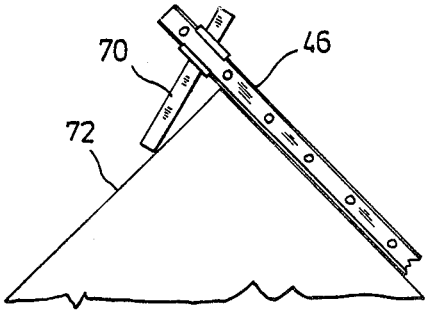
FIG. 7.

LADDER ATTACHMENT

This invention relates to a ladder attachment and, more particularly, relates to a ladder attachment which can function as a ladder standoff, ladder leg extension or roof ridge hook.

Ladder standoffs, for example, are useful in supporting an extension ladder a predetermined distance from a wall of a building while the fascia or eavestrough at the juncture of a sloped roof and a vertical wall is cleaned and painted. Ladder standoffs are well known as typified in the U.S. Pat. No. 4,184,569 which includes, as essential integers, a pair of tubular members secured to the ladder rails or legs by U-bolts passing through tubular standoffs. The standoffs are not adjustable as to length.

U.S. Pat. No. 3,027,968 shows a ladder fitting for enabling a ladder to be disposed in several desired positions. Another version of ladder standoff is shown in U.S. Pat. No. 4,159,045 wherein a ladder standoff platform is secured to the rails of a ladder to rest on the upper rung of the ladder. The platform offsets the upper end of a ladder from the face of a building and provides a platform for the support of tools.

U.S. Pat. No. 2,360,640 shows a ladder attachment for adjusting the length of the ladder legs to permit the use of the ladder on uneven or inclined surfaces. Three spaced-apart guide frames support each leg extension.

It is a principal object of the present invention to provide a ladder attachment which will usefully function as a ladder standoff, a ladder leg extender, and a roof ridge hook.

Another object of the present invention is the provision of a relatively simple and a reliable ladder attachment which makes use of wood members which will cooperate with the attachment and the ladder rails to provide a positive interconnection which is simple to assemble and safe in use.

A further object of our invention is the provision of a ladder standoff or ladder leg extender which is readily adjustable as to length.

The ladder attachment of our invention comprises, in general, a channel having a web of adjustable width and side walls substantially perpendicular to the web, a reversible angle having securing means for connecting one flange or leg of the angle to the interior of one of said side walls whereby the other flange of said angle is upstanding from said side wall either towards or away from said web relative to the securing means to receive a stile of a ladder between said angle flange and the channel web, means extending through the channel web for biasing the ladder stile away from the channel web, an opening formed in each of the channel said walls for receiving an elongated member therethrough, whereby said elongated member can be inserted through said channel wall openings as a standoff or inserted between the ladder leg and angle flange as a ladder leg extension and the ladder leg secured to the elongated member by biasing the ladder leg away from the channel web.

The walls of the channel preferably are of different length and flanged at their free ends with openings formed therein in proximity to the said free ends such that a standoff passing through said openings is inclined at an acute angle outwardly to the plane of the channel web. The openings preferably are rectangular in shape to receive wooden standoff members whereby biasing of the angle flange against the standoff positively frictionally interlocks the components together.

The web of the channel is formed of two overlapping planar components, one of said planar components having transverse slots formed therein and the other of said planar components having openings for receiving threaded bolts or having threaded bolts secured thereto adapted to pass through said slots whereby the width of the web can be readily adjusted and locked by wing nuts. The biasing means comprises a bolt threaded in one of said web components and passing through a slot formed in the other of said web components whereby the bolt can be urged against the ladder stile for biasing the ladder stile against the angle flange.

The angle can be reversed whereby the upstanding flange thereof is in substantial planar alignment with the terminal flange formed on the opposite channel side wall defining a rectangular opening whereby a leg extension can be inserted into the said opening and the ladder leg biased thereagainst by axial movement of the biasing means.

The foregoing and other objects of the invention and the manner in which they can be attained will become apparent from the following detailed description of the accompanying drawings, in which:

FIG. 5 is a sectional view of the bracket of the present invention shown securing a leg extender to a ladder leg;

FIG. 6 is a perspective view of our invention illustrated in FIG. 5 showing the extension of a ladder leg for use on an uneven surface;

FIG. 7 is a side elevation of the ladder standoff in a reversed position for securing a ladder to the ridge of a roof.

Figure 1:
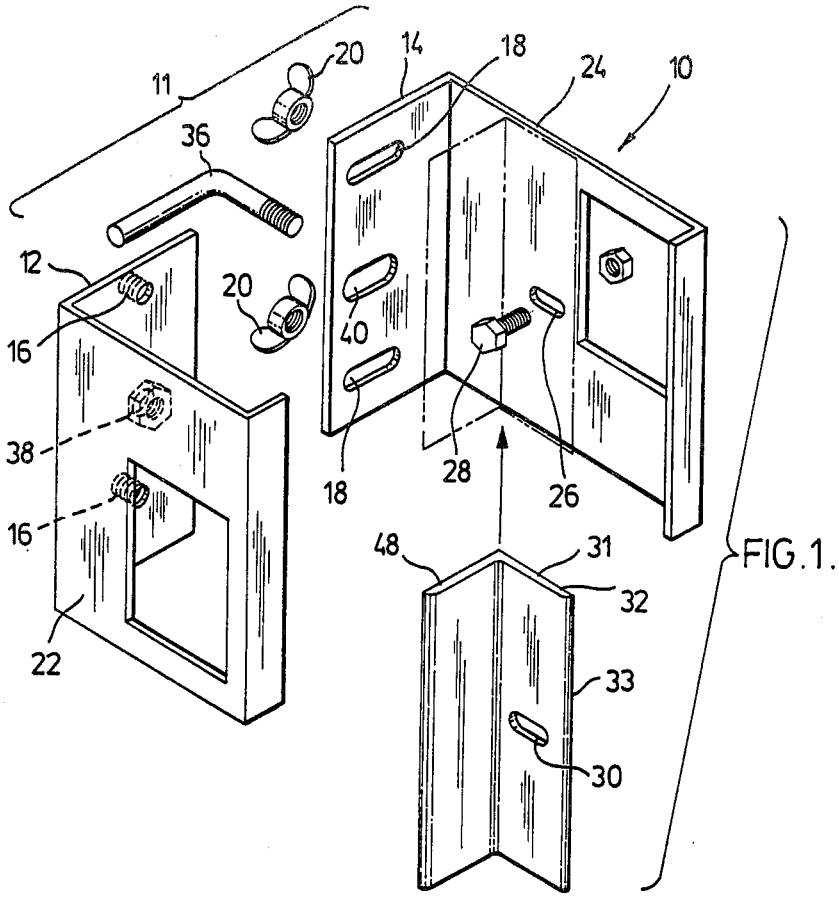
FIG. 1 is an exploded perspective view of a preferred embodiment of our invention.
Figure 2:
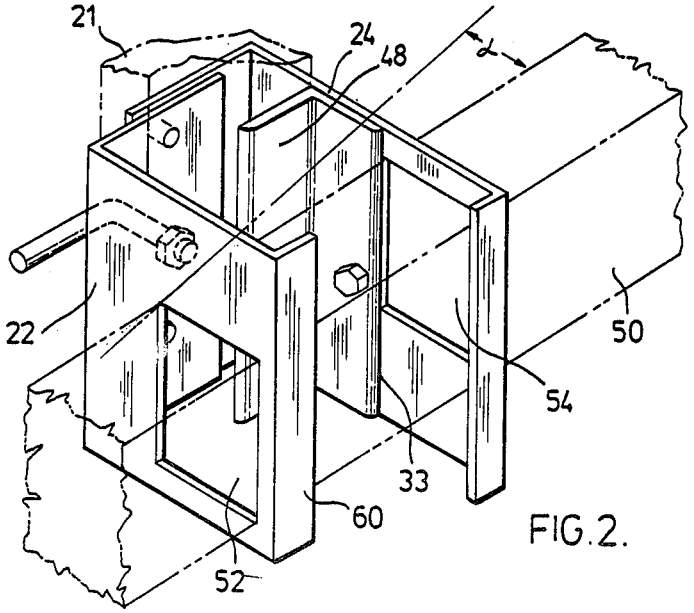
FIG. 2 is a perspective view of the construction shown in FIG. 1 in its assembled operative position illustrating a standoff by ghost lines.
Figure 3:
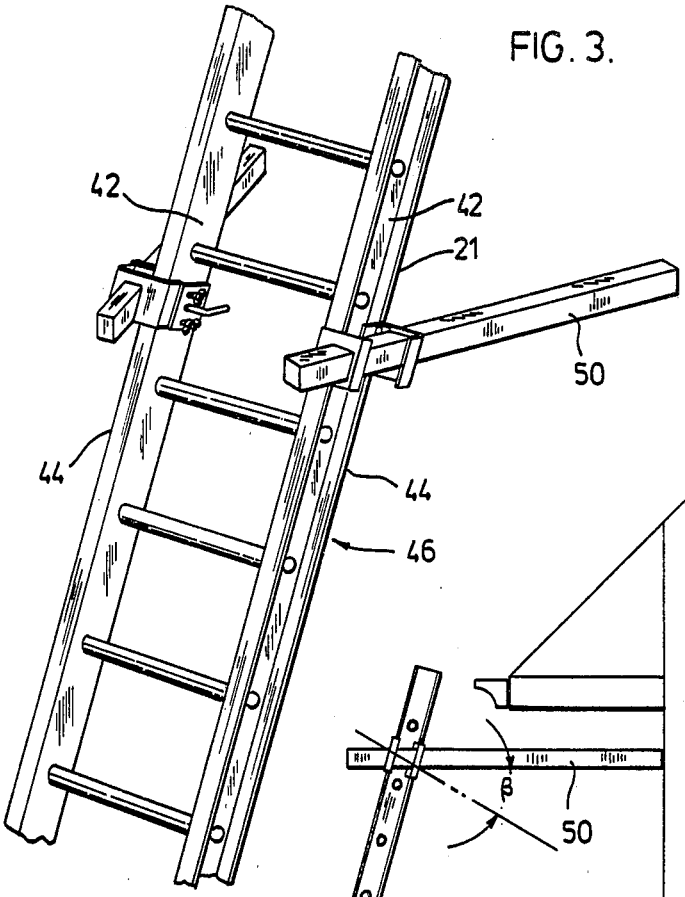
FIG. 3 is a perspective view of a pair of ladder attachments securing standoffs to ladder stiles.

With reference to the embodiment shown in FIGS. 1 through 4, the ladder attachment 10 of our invention comprises a channel with a web generally designated by numeral 11 having a pair of web components 12, 14 of planar configuration adapted to overlie each other and to be secured together by means of a pair of upstanding threaded studs 16 secured to the outer face of component 12 and passing through lateral slots 18 formed in component 14 to receive wing nuts 20. The width of web 10 thus can be readily adjusted to secure a ladder rail or leg 21, shown by ghost lines in FIG. 2, between channel sidewalls 22, 24.

Sidewall 24 has a transverse slot 26 formed therein for receiving threaded bolt 28 which is adapted to pass through a corresponding slot 30 in one angle or leg 31 of angle 32 such that leg 31 can be held against the inner side of channel wall 24 and adjusted laterally relative to web 11. Threaded handle bolt 36 is adapted to pass through nut 38 secured by brazing or welding to component 12 of web 11, whereby bolt 36 can be axially advanced through central slot 40 of web component 14 for abutment of bolt 36 against the web 42 of a stile 21 of ladder 46, as shown most clearly in FIG. 3. Tightening of bolt 36 thus mutually biases leg 21 of ladder 46 against flange 48 of angle 32 urging the edge 33 of angle 32 against standoff 50, designated by ghost lines in FIG. 2, which passes through openings 52, 54 formed in side walls 22, 24 respectively of the channel.

Openings 52, 54 are shown rectangular in shape for receiving standoff member 50, which is preferably formed of wood, for reasons which will be discussed herein below.

Channel wall 22 preferably is shorter than wall 24, and opening 52 formed in wall 22 preferably is out of lateral alignment relative to opening 54 in wall 24, such that the longitudinal axis of standoff 50 passing therethrough defines an angle $\alpha$ of about 20°–25°, preferably about 22°, to the plane of channel web 11. A pair of standoffs 50, as viewed in FIG. 3, thus would diverge outwardly away from each other to provide lateral stability to the upper end of ladder 46.

Figure 4:
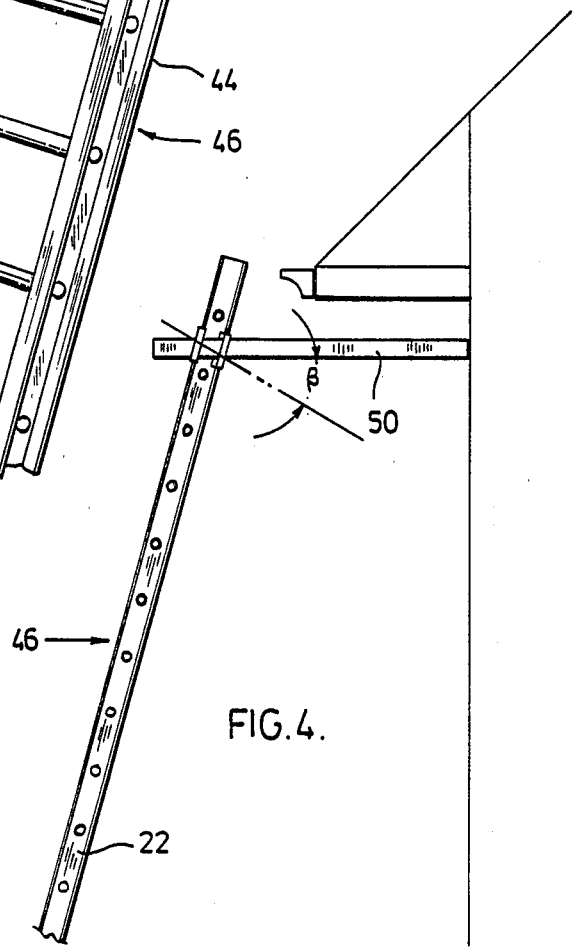
FIG. 4 is a side elevation of the apparatus shown in FIG. 3 in its operative position against a building wall.

Wall opening 52 is also out of longitudinal alignment with wall opening 54 such that each standoff 50 is inclined upwardly defining an acute angle $\beta$ relative to a line perpendicular to the longitudinal axis of the ladder, as shown most clearly in FIG. 4, of 20°–25°, preferably about 22°. The angle $\beta$ is the angle which a ladder normally defines against a vertical surface for a complementary base angle of 65°–70° with the ground such that the standoffs are substantially horizontal and abut a building wall substantially perpendicular to the vertical plane of the wall. The effective length of the standoffs can be readily adjusted to obtain the desired spacing of ladder from the wall, in the position depicted in FIG. 4.

The ladder attachment of the present invention can be readily converted to adjust the effective lengths of the ladder legs to compensate for uneven or inclined surfaces such as stairs as indicated in FIG. 6. Angle 32 is simply reversed such that upstanding flange 48 is aligned with terminal flange 60 of side wall 22, slot 26 formed in side wall 24 being of adequate length in conjunction with the length of slot 30 in flange 31 of angle 32 such that bolt 28 automatically positions angle flange 48 coplanar with flange 60.

With particular reference to FIGS. 5 and 6, leg extender 62 is loosely fitted within the rectangular opening defined between the web 42 of ladder leg 22 and flanges 48, 60 such that tightening of handle bolt 36 biases ladder leg 22 against flanges 48, 60 to positively frictionally secure extension 62 therein. The upset portion 66 of ladder rung 68 (FIG. 5) extending beyond the plane of the inner surface of web 42 of ladder web 42 assists the frictional engagement between the leg extender 62 within the assembly.

Standoff 50 and leg extender 62 preferably are formed of wood, e.g. commercial 2 inch×3 inch lumber readily available to the user, for optimum frictional engagement. The abutment of flange edge 33 on the standoff coupled with the oblique alignment of holes 52, 54 ensures positive and safe securement of the standoffs.

FIG. 7 illustrates another use of the ladder attachment of the present invention wherein standoffs 70 are inclined at an acute angle to the main body of ladder 46 by simply reversing the channels such that standoffs 70 will positively engage the ridge of roof 72 for use in roof repairs, shingling and like operations which may be dangerous to perform on a roof with a steep pitch.

Figure 8:
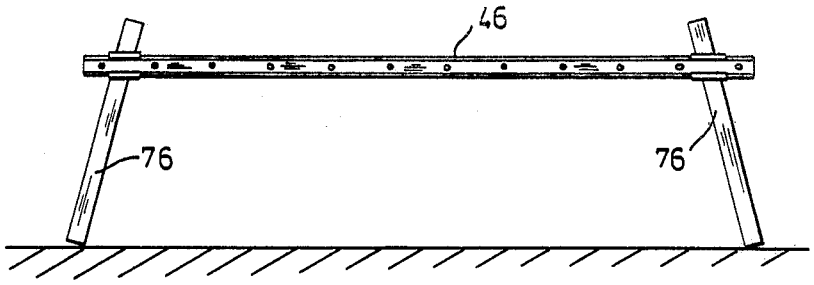
FIG. 8 is a side elevation of th ladder standoff used in pairs at each end of a ladder permitting use of the ladder as a scaffold.
Figure 9:
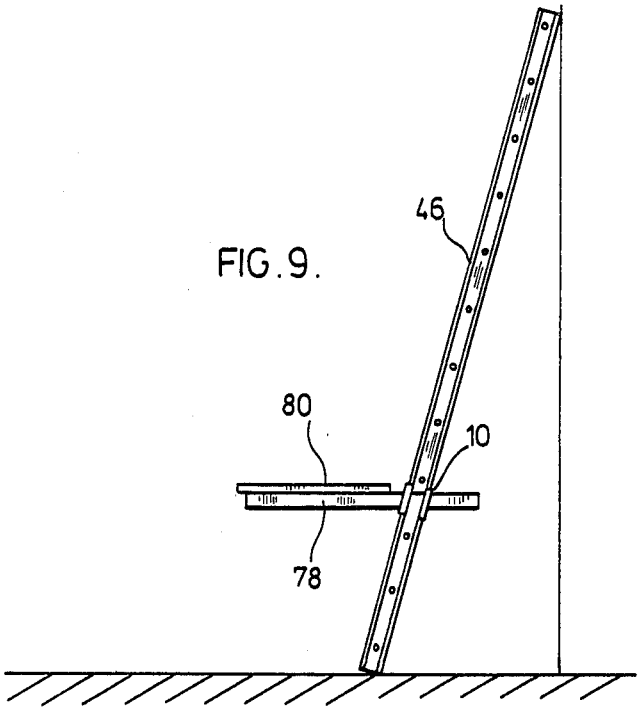
FIG. 9 is a side elevation of the ladder standoff used as a table support or sawhorse.

FIG. 8 shows a use of the ladder standoff wherein a pair of standoffs 76 are located at each end of a ladder 46 and the ladder disposed horizontally. Each standoff 76 can be adjusted for length to suit the terrain.

The standoff 78 of FIG. 8 functions as a support for table 80 or the standoff can be used as a sawhorse or workpiece support. The ladder 46 is leaned against a wall to level the standoffs 78, the length of the standoffs being readily adjusted by reversing the standoffs through the attachments 10.

The present invention provides a number of important advantages. The ladder attachment is of relatively simple construction, is easily attached to the legs of a ladder in a desired operative position, and is safe and reliable in operation. The standoffs are inclined away from each other and readily adjusted as to length to positively station a ladder against a building wall. It has been found that a ladder positioned as shown in FIG. 4 has good lateral resistance to wind loads and to the movement of the user on the ladder while it is stationed a desired distance from the eaves or fascia of a building.

It will be understood that modifications can be made in the embodiment of the invention illustrated and described herein without departing from the scope and purview of the invention as defined by the appended claims.

What we claim as new and desire to protect by Letters Patent of the United States is:

1. A ladder attachment for securement to the stile or leg of a ladder comprising, in combination, a channel having a web of adjustable width and side walls substantially perpendicular to the web, a reversible angle having securing means for connecting one flange of the angle to the interior of one of said side walls whereby the other flange of said angle is upstanding from said side wall either towards or away from said web relative to the securing means to receive a stile of a ladder between said angle flange and the channel web, means extending through the channel web for biasing the ladder stile away from the channel web, an opening formed in each of the channel side walls for receiving an elongated member therethrough, whereby said elongated member can be inserted through said channel wall openings as a standoff or inserted between a ladder leg and an angle flange as a ladder leg extension and the ladder leg secured to the elongated member by biasing the ladder leg away from the channel web.

2. A ladder attachment as claimed in claim 1 wherein the walls of the channel are of different lengths, the free ends of said walls are flanged and the wall openings are formed therein in proximity to said free ends such that an elongated member passing therethrough is inclined at an angle to the plane of the channel web of between 20° to 25°.

3. A ladder attachment as claimed in claim 2 wherein said elongated member is inclined at an angle of about 22° to the plane of the channel web.

4. A ladder attachment as claimed in claim 2 wherein the angle is secured to the interior of the longer of the two channel walls.

5. A ladder attachment as claimed in claim 4 wherein the said longer of the two channel walls and the angle flange connected to said wall have lateral slots formed therein and said securing means for connecting the angle flange comprises a bolt passing through said slots whereby the angle can be laterally adjusted towards and away from the channel web.

6. A ladder attachment as claimed in claim 4 wherein the angle is secured to the channel side wall by one flange with the other upstanding flange facing the channel web whereby biasing of the ladder stile away from the channel web urges the ladder stile against the said upstanding flange and urges the other angle flange against the elongated member to frictionally engage said elongated member.

7. A ladder attachment as claimed in claim 2, 5 or 6 wherein the wall openings are out of longitudinal alignment with each other such that the standoff is inclined at an acute angle relative to a line perpendicular to the longitudinal axis of the ladder in the range of 20°–25° whereby the standoffs will be substantially horizontal when the ladder is in its operative position.

8. A ladder attachment as claimed in claim 1 wherein one channel wall is longer than the other and the free ends of the said walls are inwardly flanged, the angle flange is secured to the interior of the longer of the two channel walls with the upstanding flange facing away from the channel web and substantially in alignment with the flanged free end of the shorter of the two channel walls, to define a rectangular opening for receiving an elongated member as a leg extension whereby biasing of the ladder leg away from the channel web urges the ladder leg against the elongated member for frictional engagement of the said elongated member between the ladder leg and the substantially aligned wall flange and angle flange.

9. A ladder as claimed in claim 5, 6 or 9 wherein said elongated member is formed of wood and said biasing means extending through said channel web is a handle bolt threaded into said web.

10. A ladder attachment as claimed in claim 5, 6 or 9 wherein said channel web comprises a pair of overlapping planar components having said side walls extending therefrom, one of said components having a pair of spaced-apart threaded studs adapted to receive nuts extending therefrom through a pair of mating lateral slots formed in the other of said components whereby the width of the channel web can be adjusted to receive a ladder leg and the web components secured together by nuts threaded on said studs.

* * * * *